US005392900A

United States Patent [19]

Sandwall

[11] Patent Number: 5,392,900

[45] Date of Patent: Feb. 28, 1995

[54] BULKHEAD DOOR ARRANGEMENT

[75] Inventor: Nils Sandwall, Gustavsberg, Sweden

[73] Assignee: Consilium CMH Babcock AB, Enkoping, Sweden

[21] Appl. No.: 170,214

[22] PCT Filed: Jul. 17, 1992

[86] PCT No.: PCT/SE92/00522

§ 371 Date: Dec. 28, 1993

§ 102(e) Date: Dec. 28, 1993

[87] PCT Pub. No.: WO93/01968

PCT Pub. Date: Feb. 4, 1993

[30] Foreign Application Priority Data

Jul. 18, 1991 [SE] Sweden ..... 9102195-6

[51] Int. Cl.[6] ..... B65G 21/08

[52] U.S. Cl. ..... 198/860.4; 198/950; 114/73

[58] Field of Search ..... 198/860.4, 950; 414/142.3, 142.4; 114/73, 116, 120

[56] References Cited

U.S. PATENT DOCUMENTS

| | | | |
|---|---|---|---|
| 3,288,097 | 11/1966 | Boston | 114/73 |
| 3,601,268 | 8/1971 | Head et al. | 114/73 X |
| 4,491,215 | 1/1985 | Meyer | 198/860.4 |
| 4,753,337 | 6/1988 | Grosjean | 198/950 X |

*Primary Examiner*—James R. Bidwell
*Attorney, Agent, or Firm*—Young & Thompson

[57] ABSTRACT

The invention relates to a bulkhead door arrangement for sealingly closing an opening which is located between two mutually adjacent spaces and through which a conveyor belt extends. The arrangement includes a vertically moveable door part provided with a sealing strip on the side thereof facing towards the conveyor belt. When the door arrangement is in its closed position, the door part presses the conveyor belt into abutment with a sealing strip provided in the bottom of the opening, and separate sealing devices abut the side edges of the conveyor belt.

10 Claims, 4 Drawing Sheets

BULKHEAD DOOR ARRANGEMENT

The present invention relates to a bulkhead door arrangement for sealingly closing an opening which is located between two mutually neighbouring spaces and through which an upper part and a lower part of a conveyor belt extend, said arrangement including a vertically moveable upper door part provided with a sealing strip on the side thereof facing the conveyor belt, a moveable lower door part which is placed between the two parts of the conveyor belt and separate sealing devices abut the side-edge surfaces of the conveyor belt in the closed position of said door parts.

A similar bulkhead door arrangement for seagoing vessels, or ships, is known to the art, by means of which a bulkhead opening through which a conveyor belt having an upper and a lower part extends can be closed in a water-tight-fashion. This known door arrangement comprises moveable and stationary door parts which are mounted vertically and provided with sealing strips and which lie sealingly against the upper and the lower parts of the conveyor belt when the door is closed.

When the door of this known arrangement is closed, small triangular openings remain externally of the side edges of the conveyor belt, due to the fact that the sealing strips are not able to abut the edges of the belt, resulting in incomplete sealing of the bulkhead opening.

The object of the present invention is to provide a bulkhead door arrangement which will provide a complete seal when the door is closed.

This is achieved in accordance with the invention by means of a door arrangement of the aforesaid kind which is characterized in that the lower door part is vertically moveable; and in that the upper door part in its closed position presses the conveyor belt with a predetermined force against a sealing strip arranged in the bottom of the opening in such a manner that the upper door part controls the vertical movement of the lower door part.

According to one preferred embodiment, the upper door part functions, during the course of a door closing movement, to first press the upper part of the conveyor belt against an upper sealing strip on the lower door part and then press said upper part together with the lower door part down against the lower part of the conveyor belt until said lower part is brought into abutment with the sealing strip provided at the bottom of the door opening, with a predetermined abutment pressure. The sealing devices include upper and lower sealing elements which respectively abut the side-edge surfaces of the upper and the lower part of the belt.

The sealing devices are further vertically moveable and include sealing surfaces which, during closing of the bulkhead door, come into abutment with the various side-edge surfaces of the conveyor-belt parts, irrespective of the lateral positions of said side edges, that is within a given positional range.

The conveyor belt includes a part having side-edge surfaces which are inclined relative to a longitudinal vertical plane. Those elements of the sealing devices which coact with the side-edge surfaces of said part include a sealing surface which is inclined to a longitudinal vertical plane the same angle of inclination as the corresponding side-edge surfaces of said part and which have an extension which is greater than the width of the side-edge surface.

The conveyor belt also includes a part which has vertical side-edge surfaces, wherein those elements of the sealing devices which coact with the side-edge surfaces of this part are moveable both vertically and laterally and each includes a vertical sealing surface whose extension is greater than the width of the side-edge surface.

According to another preferred embodiment, the arrangement includes a device which acts on the lower sealing elements by virtue of its weight when the door arrangement is closed. When the door arrangement is open, the sealing elements are carried by the upper door part.

The invention will now be described in more detail with reference to an exemplifying bulkhead door arrangement illustrated schematically in the accompanying drawings.

Figure 1:
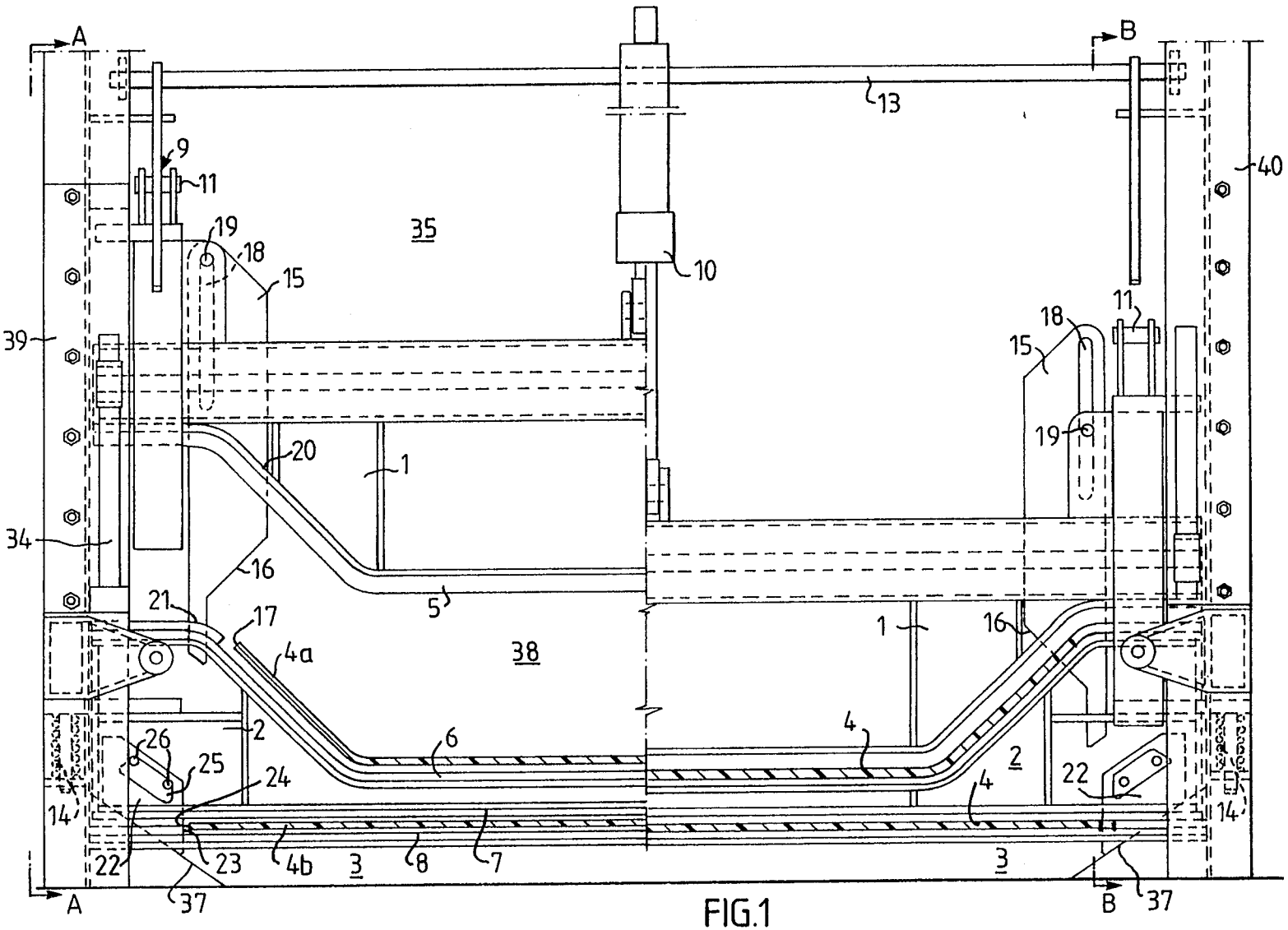
FIG. 1 illustrates a door arrangement in both the closed and the open position of the door.
Figure 2:
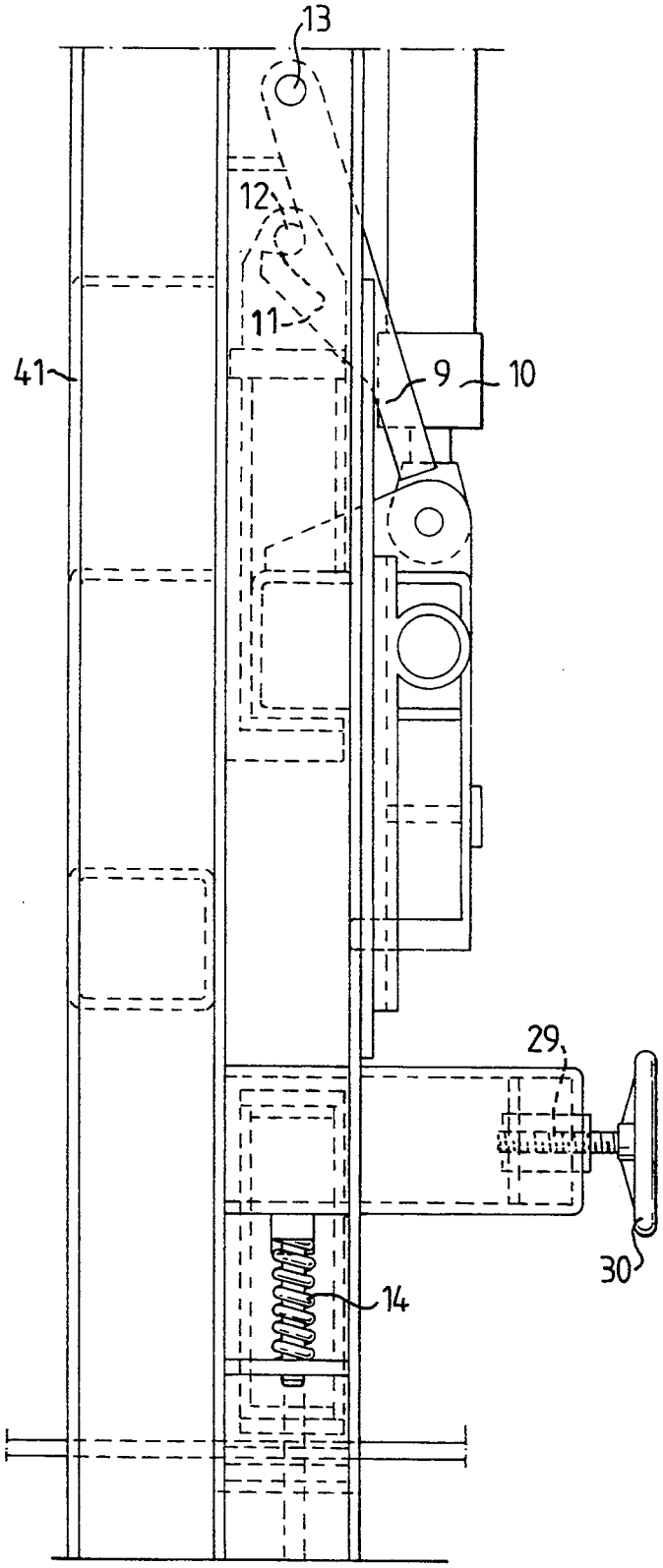
FIG. 2 is a sectional view taken on the line A—A in FIG. 1, with the door arrangement open.
Figure 3:
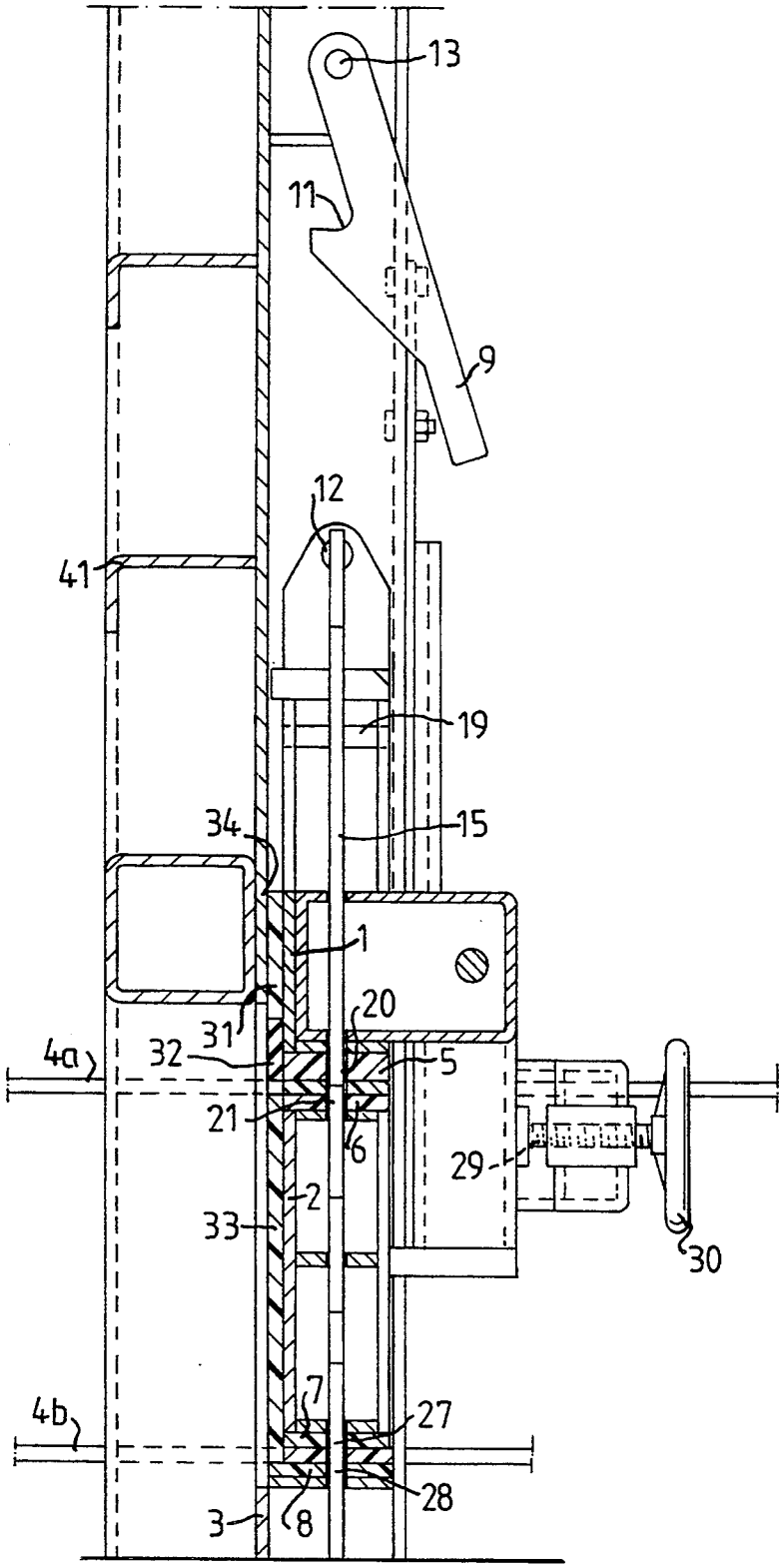
FIG. 3 is a sectional view taken on the line B—B in FIG. 1, with the door arrangement closed.

FIG. 1 is a front view of a bulkhead door arrangement which functions to close an opening 38 in the bulkhead of a ship, only a part of the bulkhead being shown in FIG. 1. The opening 38 is defined by an upper, permanently fixed wall part 35 of the bulkhead, the bulkhead side-beams 39, 40 and a lower permanently fixed wall part 3.

The door arrangement includes two vertically moveable doors parts mounted one above the other, i.e. an upper door part 1 and a lower door part 2. Extending horizontally between the fixed wall-parts is an endless conveyor belt 4, whose upper part or run 4*a* passes between the upper door part 1 and the lower door part 2, the bottom part or run 4*b* of the belt passes between the bottom door part 2 and the fixed wall-part 3. Those surfaces of the wall-part 3 and the door parts 1, 2 which face towards the belt 4 are provided with sealing strips 5, 6, 7 and 8.

The bottom door part 2 is urged towards a door-open position by a pair of springs 14. When closing the door, the lower door part is pressed downwards under the influence of the upper door part, as described in more detail here below.

Upper sealing elements in the form of plates 15 are carried by the upper door part 1 in its door-open position and each of said plates has a sealing surface 16 which in the closed position of the door abuts the edge-surfaces 17 of the upper-part 4*a* of the conveyor belt. Each of the plates 15 has provided therein a slot 18 which receives a pin 19 attached to the upper door part 1. The plates 15 move in recesses 20, 21 formed in the upper door part 1 and the lower door part 2 and its sealing strips 5, 6. The plates are thus vertically moveable in relation to the upper door part 1.

A hydraulic piston-cylinder device 10 suitably attached to the upper, fixed wall-part 35 functions to raise and lower the upper door part 1. The upper door part is held locked in a door-open position by means of a locking device 9 provided with hooked members 11 which engage around pins 12 attached to respective sides of the upper wall-part 1. The hooked members 11 are forced to coact via a transverse shaft 13.

The lower sealing elements 22 have a vertical sealing surface 23 which in the door-closed position abut the edges 24 of the lower part 4*b* of the conveyor belt. The lower sealing elements are provided with a trapezoidal penetrating aperture 25 into which two pins 26 are inserted, in order to restrict movement of the sealing element. The sealing elements move in recesses formed in the lower door part 2 and the lower wall-part 3 and its sealing strips 7, 8. The sealing elements 22 also rest on an inclined surface 37 and the sealing elements endeavour to move downwards along said surface under the force of gravity.

Sealing strips 31, 32, 33 are fitted to the rear sides of the upper door part 1 and the lower door part 2 and are distributed such that a sealing strip 31 extends along the upper part of the upper wall-part 1 and a sealing strip 32 extends along the edges of said upper wall-part. When the arrangement is in its door-closed position, the sealing strips are in abutment with a sealing surface 34 which extends from one edge of the fixed wall-part 3, along the side beam 39 and up to the bulkhead part 35, and extends further along the lower part of said bulkhead part 35 and along the second side-beam 40 and down to the fixed wall-part 3. Those edge surfaces of the lower door part 2 which face towards the sealing surface 34 are provided with sealing strips 33. Tensioning screws 29 operated by means of wheels 30 function to press the upper door part 1 and the lower door part 2 against the sealing surface 34 via the sealing strips 31, 32, 33 and therewith lock the wall-parts in horizontal and vertical positions. In order to ensure the evenness of the sealing surface 34 and to facilitate sliding of the door parts, corresponding parts of the side-beams and bulkhead-part 35 may be made of corrosion-resistant material, such as stainless steel for instance.

The door parts may also be locked in their closed positions by means of locking devices of the kind described above for mechanical locking of the upper door part in its door-open position, or by any other appropriate type of locking means.

Prior to closing the door, the upper door part 1 is locked firmly in its door-open position. The conveyor belt is empty and clean, and an operator is stationed on each side of the door arrangement.

An operator raises the upper door part 1 at the same time as the other operator releases a latching or locking device 9 which secures said upper door part 1, whereafter the upper wall-part 1 and the upper sealing elements 15 mounted on said wall-part are lowered down onto the upper part 4*a* of the conveyor belt 4.

When the inclined sealing surface 16 of the upper sealing element 15 comes into contact with the edge 17 of the belt, movement of the upper element 15 ceases whereas the upper door part 1 continues to move downwards. When the upper door part 1 reaches the conveyor belt 4, the conveyor belt is pressed further towards the lower door part 2 and the upper sealing devices 15 accompany the conveyor belt 4 in its downward movement, which in turn urges the lower part 4*b* of the conveyor belt against the fixed wall-part 3 at the same time as the lower sealing elements 22 slide in towards the edges 24 of the lower part of the conveyor belt.

When the sealing strips 5, 6 and 7 are compressed in the closed positions of the door parts, by being compressed between the upper and the lower door parts and also between the lower door part and the fixed wall-part 3, the sealing strips expand laterally and come into sealing abutment with the plates 15 and the lower sealing elements 22 respectively.

According to another variant, the lower sealing elements 22 may be activated by the upper door part 1 in a manner such that when the upper door part 1 is lowered, the weight of a device 36 carried by the upper door part in its open position causes the lower sealing elements 22 to move towards the edge surfaces 24 on the lower part of the conveyor belt 4*b*. The sealing elements, both the upper sealing elements 15 and the lower sealing elements 22, can be moved advantageously without activation by the wall-parts, for example with the aid of hydraulic piston-cylinder devices, spindles or the like (not shown in the drawings).

The door parts are finally pressed against the sealing surface 34 with the aid of tensioning or tightening screws 29 provided on each side of the bulkhead door arrangement, these tensioning screws, together with mechanical locking devices, ensuring that the door arrangement cannot be opened inadvertently. The tensioning screws exert sufficient horizontal pressure to fix and seal the door parts against the sealing surface 34 located behind said door parts. The tensioning screws 29 can be replaced with other tensioning or tightening devices, such as an appropriate link mechanism or the like.

The bulkhead door arrangement is opened by carrying out the aforedescribed door-closing procedures in the reverse order.

Figure 4:
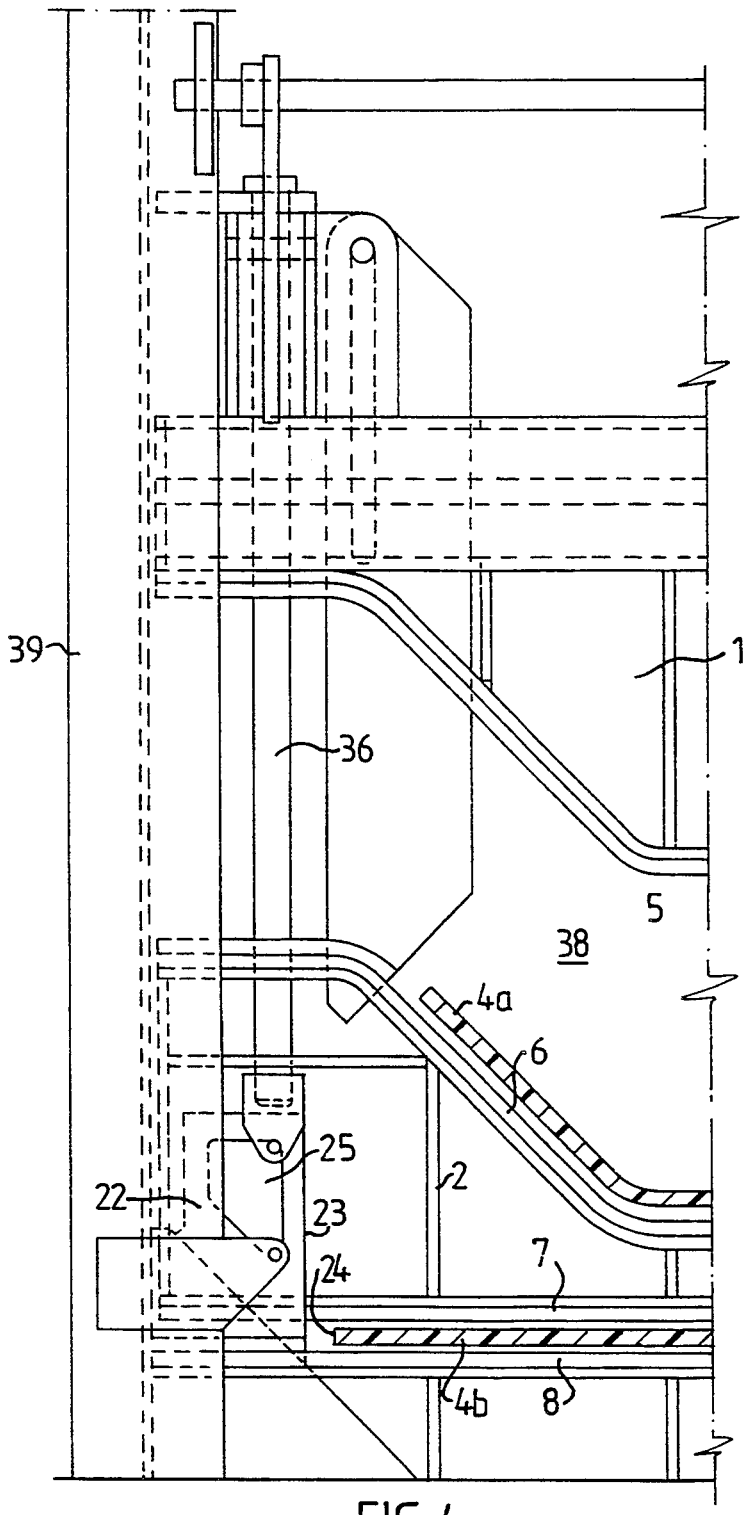
FIG. 4 illustrates an alternative embodiment of the door arrangement shown in FIG. 1 (the tensioning screws are omitted).

In the case of a preferred embodiment, illustrated in FIG. 4, the lower sealing elements 22 are acted upon by the weight of two rods or bars 36 which, when the door arrangement is open, are carried by the upper door part 1 and which, in turn, then carry the lower sealing elements 22 which are not in contact with the conveyor belt at this time. When the upper door part 1 occupies its door-open position, the lower sealing elements are suspended from a stirrup-like structure provided at one end of respective rods or bars 36. When the upper door part is closed, the bar 36 accompanies the closing movement of said door part until the bar comes into abutment with corresponding lower sealing element 22, wherewith the weight of said bar exerts a downwardly acting force on said element.

The device 36 may have a form other than a bar or rod, for example the form of a weight attached to the upper door part by means of a wire.

I claim:

1. A bulkhead door arrangement for sealingly closing an opening (38) which is located between two mutually neighbouring spaces and through which an upper part (4*a*) and a lower part (4*b*) of a conveyor belt (4) extend, said arrangement including a vertically moveable upper door part (1) provided with a sealing strip (5) on the side thereof facing the conveyor belt, a moveable lower door part (2) which is placed between the two parts (4*a*) and (4*b*) of the conveyor belt (4) and separate sealing devices (15, 22) abut the side-edge surfaces (7, 24) of the conveyor belt in the closed position of said door parts; characterized in that the lower door part (2) is vertically moveable; and in that the upper door part (1) in its closed position presses the conveyor belt (4) with a predetermined force against a sealing strip arranged in the bottom of the opening in such a manner that the upper door part (1) controls the vertical movement of the lower door part (2).

2. An arrangement according to claim 1, characterized in that in the course of closing the bulkhead door arrangement, the upper door part (1) is intended to first press the upper conveyor part (4*a*) against an upper sealing strip (6) on the lower door part and then press the upper conveyor part (4*a*) together with said lower door part down against the lower conveyor part (4*b*) until said lower part (4*b*) is brought into abutment with the sealing strip (8) at the bottom of the opening with a predetermined abutment pressure; and in that the sealing devices include upper (15) and lower elements (22) which abut the side-edge surfaces (17, 24) of the upper conveyor the lower conveyor parts respectively.

3. An arrangement according to claim 1, characterized in that the sealing devices (15, 22) are vertically moveable and include sealing surfaces (23) which, when closing the door arrangement, come into abutment with the various side-edge surfaces (17, 24) of the top and bottom conveyor parts (4*a*, 4*b*), irrespective of the lateral positions of said edge surfaces, within a given range.

4. An arrangement according to claim 3, in which the conveyor belt (4) includes a part (4*a*) having side-edge surfaces (17) which are inclined in-relation to a longitudinal vertical plane, characterized in that those elements (15) of the sealing devices which coact with the side-edge surfaces (17) of said conveyor part include a sealing surface (16) which is inclined relative to a longitudinal vertical plane at the same angle of inclination as corresponding side-edge surfaces (17) of said conveyor part (4*a*) and which have a greater extension than the width of the side-edge surfaces (17).

5. An arrangement according to claim 3, in which the conveyor belt (4) includes a part (4*b*) having vertical side-edge surfaces (24), characterized in that those elements (22) of the sealing devices which coact with the side-edge surfaces (24) of said conveyor part are moveable vertically and laterally and each include a vertical sealing surface (23) whose extension is greater than the width of the side-edge surface.

6. An arrangement according to claim 4, in which the upper part (4*a*) of the conveyor belt has side-edge surfaces (17) which are inclined in relation to a longitudinal vertical plane, characterized in that the upper elements (15) of the sealing devices have the form of plates which are carried by the upper door part (1) and which are vertically moveable in relation to said door part in a manner such that when the upper door part (1) is moved to its closed position, said plates accompany the movement of said door part until said plates come into abutment with respective side-edge surfaces (17) of the upper conveyor part (4*a*), and such that said plates accompany the upper door part (1) during the final stage of its opening movement when moving said door part to its open position.

7. An arrangement according to claim 6, characterized in that each of the plates is provided with a vertical slot (18) in which a pin (19) mounted on the upper door part runs, said pin carrying the plate in the open position of the upper door part and guiding the movement of said plate in relation to said door part when said door part moves towards its closed position.

8. An arrangement according to claim 1, characterized in that the sealing devices abut the side-edge surfaces of the conveyor belt with a predetermined abutment pressure, this pressure being achieved through the intrinsic weight of the sealing devices.

9. An arrangement according to claim 1, characterized by separate force-generating means which function to urge the sealing devices against the side-edge surfaces of the conveyor belt.

10. An arrangement according to claim 9, characterized in that in the closed position of the door arrangement, the lower sealing elements (22) are acted upon by the intrinsic weight of the force generating devices (36); and in that in the open position of the door arrangement, the devices (36) are carried by the upper door part (1) and, in turn, carry the lower sealing elements (22).

* * * * *